US005269856A

United States Patent [19]

Igawa et al.

[11] Patent Number: 5,269,856

[45] Date of Patent: * Dec. 14, 1993

[54] PROCESS FOR PRODUCING HIGH STRENGTH ENDLESS STEEL BELT HAVING A DUPLEX STRUCTURE OF AUSTENITE AND MARTESITE

[75] Inventors: Takashi Igawa; Yoshihiro Uematsu; Toshihiko Takemoto, all of Yamaguchi, Japan

[73] Assignee: Nisshin Steel Co., Ltd., Japan

[ * ] Notice: The portion of the term of this patent subsequent to Dec. 15, 2009 has been disclaimed.

[21] Appl. No.: 976,054

[22] Filed: Nov. 13, 1992

Related U.S. Application Data

[63] Continuation-in-part of Ser. No. 773,820, Oct. 9, 1991, abandoned.

[30] Foreign Application Priority Data

Oct. 16, 1990 [JP] Japan ..... 2-275422

[51] Int. Cl.[5] ..... C21D 8/02

[52] U.S. Cl. ..... 148/609; 148/611

[58] Field of Search ..... 148/609, 611

[56] References Cited

U.S. PATENT DOCUMENTS 5,171,384 12/1992 Igawa et al. ..... 148/611

*Primary Examiner*—W. Dean
*Assistant Examiner*—Sikyin Ip
*Attorney, Agent, or Firm*—Lowe, Price, LeBlanc & Becker

[57] ABSTRACT

A high strength steel belt having an excellent flatness and a duplex structure of austenite and martensite has been prepared by a process which comprises providing a cold rolled or cold rolled and annealed strip of a martensitic structure from low carbon martensitic stainless steel containing from 10 to 17% by weight of Cr and having a carbon content of not exceeding 0.15% by weight, connecting ends of the strip or ends of a plate cut from said strip to provide an endless belt, causing the endless belt to circularly move between rolls under tension and to pass through a heating furnace where the belt is heated to a temperature within a range from (As point of the steel+30° C.) to Af point of the steel and not higher than 900° C. so that a part of the martensitic phase may be changed to a reversed austenitic phase and a desired surface flatness may be obtained after cooling.

5 Claims, 2 Drawing Sheets

PROCESS FOR PRODUCING HIGH STRENGTH ENDLESS STEEL BELT HAVING A DUPLEX STRUCTURE OF AUSTENITE AND MARTESITE

RELATED APPLICATION

This application is a continuation-in-part application to our application Ser. No. 07/773,820 filed Oct. 9, 1991, now abandoned.

FIELD OF THE INVENTION

The invention relates to a process for the production of a high strength stainless steel belt having a fine duplex structure of martensite and austenite and an excellent flatness.

BACKGROUND OF THE INVENTION

Stainless steel belts are widely used in various fields including, for example, continuous baking of cookies at high temperatures, freezing of foods at low temperatures, continuous pressing of ply wood and transportation of mechanical parts. Since high strength and excellent fatigue strength are required, steel species constituting such belts are generally selected from work hardened austenitic stainless steels, low carbon martensitic stainless steels and precipitation hardened stainless steels.

JP B 51-31085 discloses a low carbon martensitic stainless steel for use in the production of a steel belt comprising by weight from 0.03 to 0.06% of C, 0.5 to 1.0% of Si, not more than 0.3% of N, from 3 to 10% of Ni, from 10 to 18% of Cr, and optionally from 5 to 16 times (C+N) of Ti, the balance being Fe and impurities. It is taught that when a strip of this steel is used in the annealed condition to prepare an endless steel belt by end welding, the endless belt has a high strength in the weld zone and exhibits an extremely reduced deformation due to local heating for the welding.

JP A 61-9903 discloses a process for the production of a steel belt comprising cold rolling a strip of maraging steel or a precipitation hardenable stainless steel to a thickness of 1 mm or less, welding ends of the strip to provide an endless belt, cold working the endless belt at a working rate of from 20 to 50% and aging the cold worked endless belt. The aging is carried out under no tension. It is taught that the endless belt so prepared has satisfactory hardness and tensile strength in the weld zone.

While both the above-mentioned Japanese publications discussed the strength or hardness of the welded endless belt in the weld zone, they make no mention of the surface flatness of the endless belt.

In order to produce a stainless steel belt having a good shape, it will be necessary to prepare a flat stainless steel strip by a process including a rolling step for shape rectification. This step of rolling for shape rectification should be appropriately carried out, while carefully selecting conditions including, for example, rolling reduction, diameters of rolls and rate of rolling, depending upon the steel species, thickness of the strip and histories of the precedent production steps, or otherwise a flat stainless steel strip cannot be obtained or the production yield is reduced. Accordingly, it is eagerly desired to prepare a stainless steel strip excellent in flatness without the rolling step for shape rectification. Unfortunately, the desired technology is not yet established on the concerned steel species.

Even if a flat stainless steel strip has been prepared by rolling for shape rectification, when an endless belt is prepared from the flat strip by end welding, it is unavoidable that a strain due to expansion and contraction of the material is induced near the weld zone as a result of the welding. For this reason, the endless belt so prepared must be again flattened by stretching or by stretching and rolling.

Thus, in order to produce a high strength stainless steel belt in a high production yield, precise and complicated steps have been required. Particularly, when a wide steel belt is to be produced, two or more starting plates are longitudinally welded side by side to provide a wide welded plate, which is then made endless by end welding. In such a case, the flattening of the welded wide endless belt under tension is further complicated, time consuming and technically very difficult.

U.S. Pat. No. 4,878,955 to Hoshino and Igawa discloses and claims a process for preparing a process for preparing a high strength stainless steel material having excellent workability free from weld softening consisting of a single martensitic phase of a duplex phase structure of martensite and minute austenite, the process comprising heat-treating at a temperature of 550° to 675° C. for 1 to 30 hours cold rolled material of a steel wherein no annealing treatment is performed between a final cold rolling step and said heat-treatment step, said steel consisting essentially of:

C: not more than 0.10%
Si: 0.85–4.5%
Mn: 0.20–5.0%
P: not more than 0.060%
S: not more than 0.030%
Cr: 10.0–17.0%
Ni: 3.0–8.0%
N: not more than 0.10% and Fe and inevitable impurities, wherein the $Ni_{eq}$ value is defined as:
$Ni_{eq}=Ni+Mn+0.5\ Cr+0.3\ Si+20(C+N)$ is in the range of 13.0–17.5.

This U.S. patent is, however, completely silent with respect to a stainless steel endless belt and does not deal with a problem of surface flatness of a stainless steel endless belt.

OBJECT OF THE INVENTION

An object of the invention is to solve the above discussed problems associated with the prior art of stainless steel endless belt.

SUMMARY OF THE INVENTION

According to the invention, there is provided a process for the production of a high strength steel belt having a duplex structure of austenite and martensite which comprises providing a cold rolled or cold rolled and annealed strip of a martensitic structure from low carbon martensitic stainless steel containing from 10 to 17% by weight of Cr and having a carbon content of not exceeding 0.15% by weight, connecting ends of the strip or ends of a plate cut from said strip to provide an endless belt, causing the endless belt to circularly move between rolls under tension and to repeatedly pass through a heating furnace where the belt is heated to a temperature within a range from (As point of the steel+30° C.) to Af point of the steel and not higher than 900° C. so that a part of the martensitic phase may be changed to a reversed austenitic phase and a desired surface flatness may be obtained after cooling, and cooling the heated belt to ambient temperature, wherein the As point of the steel is a temperature of the steel of which temperature is being raised at which the transformation of martensite to austenite begins and the Af point of the steel is a temperature of the steel of which temperature is being raised at which the transformation of martensite to austenite is finished.

FUNCTION

In the process according to the invention, an endless belt of a martensitic structure spanning rolls under an appropriate tension is caused to circularly move between the rolls, and during the circular movement the belt is caused to repeatedly pass through a heating furnace where it is heated to a temperature within a range from (As point of the steel+30° C.) to Af point of the steel and not higher than 900° C. In the furnace a part of the martensite is reversed to austenite while the belt is under a longitudinal tension. The belt is effectively flattened as the reversion proceeds, even in cases wherein the belt is made of a steel strip prepared by a process without a step of rolling for shape rectification and wherein a step of flattening the endless belt by tension has been eliminated after the welding step.

The reversed austenite grains are fine and so stable that they do not retransform to quenched martensite when cooled to ambient temperature. Thus, the steel belt produced by the process according to the invention has a fine duplex structure of martensite and reversed austenite. The fact that the reversed austenite does not retransform to quenched martensite upon cooling from the heating temperature leads to no strain due to quenching, indicating that the good flatness of the belt achieved in the heating furnace can be retained to ambient temperature.

Thus, a high strength steel belt having a good shape can be easily produced by the process according to the invention wherein an endless belt of a substantially martensitic structure is concurrently flattened and transformed to a duplex structure by the heat treatment prescribed herein. The endless belt may be made of a steel strip prepared by a process without a step of rolling for shape rectification, although it may be made of a shape-rectified steel strip.

For the function described above to proceed, it is sufficient that the steel prior to the heat treatment has a substantially martensitic structure. The presence of a small amount, for example, up to 20% by volume of ferrite or austenite is permissible.

The basic concept of the invention is to produce a high strength steel belt excellent in flatness by forming a fine duplex structure of martensite and fine reversed austenite upon heating and maintaining the fine duplex structure to ambient temperature. In other words, the invention achieves a high strength by making the structure fine as known from the Hall-Petch'es formula, and realizes a tension annealed condition to ensure a good shape by causing the reversion to proceed while relaxing the flattening tension on the material passing through the heating furnace. Accordingly, it is essential to form a stable, fine duplex structure. If the heat treatment temperature is substantially lower than (As point of the steel+30° C.), the amount of the reversed austenite is insufficient, and if the heat treatment temperature is higher than 900° C. or the Af point of the steel, no martensite is retained or the amount of the retained martensite becomes too small, and thus, the desired stable and fine duplex structure is not obtained.

The process according to the invention is characterized by simultaneously carrying out the flattening of the endless belt and the formation of the duplex structure. When an uneven belt is held under tension, while the belt temporarily becomes flattened, a distribution of internal strain in the temporarily flattened belt is not uniform. Accordingly, when the tension is released, the belt returns to its original uneven shape. In the process according to the invention, the reversion of martensite to austenite proceeds under such a condition that the belt is temporarily flattened under tension. As a result, in that part of the belt where a large internal exists crystalline structure is rearranged so that the internal strain becomes minimum. In other words the reversion proceeds in the stretched belt so that the distribution of internal strain may become uniform. Accordingly, the belt does not return to its original uneven shape and remains flat, even after the tension is released.

PREFERRED EMBODIMENTS OF THE INVENTION

Figure 1:
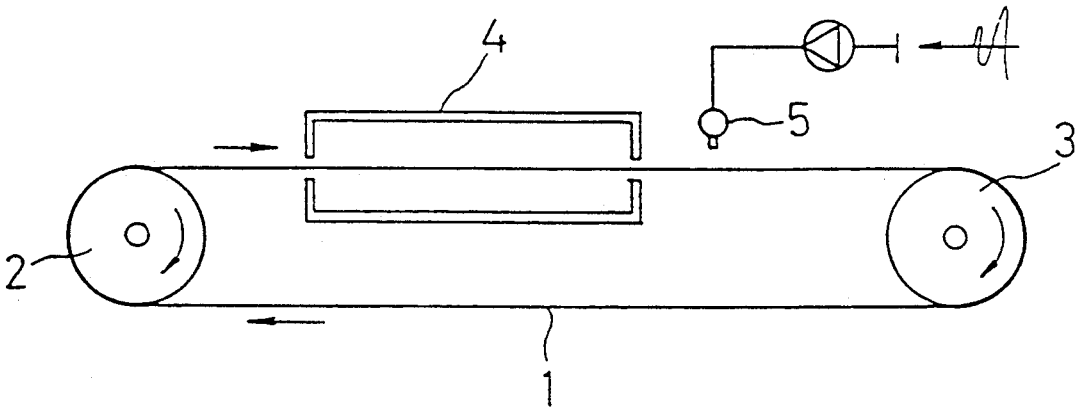
FIG. 1 is a schematic cross-sectional view of a heat treatment installation which can be used in the process according to the invention.

FIG. 1 shows an example of a heat treatment installation which can be used in carrying out the process according to the invention. An endless belt 1 which is made from a martensitic stainless steel and spans rolls 2 and 3 is caused to circularly move between the rolls by driving one of them. A heat treating furnace 4 is provided so that the circularly moving endless belt 1 may repeatedly pass through the furnace 4. The furnace 4 may be provided on its belt exit side with an air jet nozzle 5 which may serves to cool the heat treated belt when desired. While the furnace 4 is conveniently heated electrically, it may be heated by fuel combustion as well. The atmosphere of the furnace may be air, but if oxidation of the belt should be avoided, reducing or inert gas may be used.

The endless belt 1 may be prepared by cutting out a starting material plate having a required length from a martensitic steel strip, and welding ends of the plate. In some cases ends of the plate may connected by rivetting. When a wide belt is desired, it may be prepared by longitudinally welding two or more starting plates side by side and welding ends of the so welded wide plate to make it endless. The martensitic steel strip from which the endless belt 1 is prepared may be one that has not been subjected to a rolling step for shape rectification. Furthermore, the endless belt 1 need not be mechanically shape rectified prior to the heat treatment according to the invention. The endless belt can be flattened by the heat treatment according to the invention.

The endless belt 1 is hung between rolls 2 and 3 under an appropriate tension and caused to circularly move between the rolls. A suitable tension is 0.5 kgf/mm$^2$ or higher when the heat treatment temperature used is relatively low (near the As point+30° C.). Whereas when the heat treatment temperature used is near the Af point a relatively low tension below 0.5 kgf/mm$^2$ is preferred. The lower the heat treatment temperature the longer the heat treatment time, and the higher the heat treatment temperature the shorter the heat treatment time. While the optimum tension and heat treatment time depend upon the particular composition of the steel and the particular heat treatment temperature, they should be selected so that a part of the martensite may be reversed to austenite to provide a fine duplex structure and the belt may be flattened during the heat treatment. These conditions can be determined by carrying out several experiments on the particular steel.

By the heat treatment of the endless belt under tension according to the invention a desirably fine duplex structure is realized and by maintaining the fine duplex structure there can be produced a high strength steel belt excellent in shape, in which the weld zone and mother metal have substantially the same structure and flatness. Accordingly, upon the heat treatment it is essential to form a desirably stable and fine duplex structure. If the heat treatment temperature is substantially lower than (the As point of the steel+30° C.), the amount of the reversed austenite is insufficient, and the heat treatment temperature is higher than 900° C. or the Af point of the steel, a large amount of austenite is formed, retaining no or an insufficient amount of martensite, and thus, the desired stable and fine duplex structure is not obtained. Accordingly, the heat treatment should be carried out at a temperature within the range from (the As point of the steel+30° C.) to the Af point of the steel and not higher than 900° C.

The steel used herein is substantially martensitic in the annealed condition. The structure of the endless belt prior to the heat treatment should be substantially martensitic. The endless belt can be prepared from an annealed steel strip which has been made martensitic in the final annealing step, a cold rolled steel strip prepared by finish cold rolling the above mentioned annealed steel strip, or a cold rolled strip in which strain induced martensite has been formed by cold rolling. The structure of the belt prior to the heat treatment need not be 100% martensitic. The presence of a minor amount, for example, up to 20% by volume, of ferrite or austenite is permissible. In any event, it is intended that the belt should have a tensile strength as high as the order of 100 kgf/mm$^2$ or higher in the heat treated condition.

As to the chemical composition, the steel used herein is a low carbon martensitic stainless steel containing from 10 to 17% by weight of Cr and having a carbon content of not exceeding 0.15% by weight. Ni can also be a principal alloying element. Furthermore, the steel may contain other alloying elements normally contained in low carbon martensitic stainless steel.

Typical alloying elements and contents thereof by weight are as follows:

C: 0.15% or less (exclusive O),
Si: 6.0% or less (exclusive O),
Mn: 10.0% or less (exclusive O),
Ni: 8.0% or less (exclusive O),
Cr: 10.0 to 17.0%,
N: 0.3% or less (exclusive O),
Mo: 4.0% or less (inclusive O),
Cu: 4.0% or less (inclusive O),
Co: 4.0% or less (inclusive O).

In addition, the steel used herein may contain Ti, Al, Nb, V, Zr, B and rare earth elements in an amount of 1.0% or less in total, and unavoidable impurities.

Furthermore, amounts of the alloying elements are mutually controlled so that the nickel equivalent, $Ni_{eq}$, of the steel may fall within the range between 8.0 and 17.5. The nickel equivalent, $Ni_{eq}$, of the steel is defined as follows.

$$Ni_{eq}=Ni+Mn+Cu+Mo+0.2\ Co+0.5\ Cr+0.3\ Si+20(C+N),$$

in the case wherein the steel contains none of Ti, Al, Nb, V, Zr, B and rare earth elements, whereas $$Ni_{eq}=Ni+Mn+Cu+Mo+0.2\ Co+0.5\ Cr+0.3\ Si$$

in the case wherein the steel contains any one of Ti, Al, Nb, V, Zr, B and rare earth elements.

The reasons for such numerical restriction are as noted below.

C is an austenite forming element and serves not only to effectively stabilize the reversed austenitic phase formed during the heat treatment according to the invention at a temperature within the range from (the As point of the steel+30° C.) to the Af point of the steel but also to effectively strengthen the martensite and reversed austenite phases. However, the presence of an excessive amount of C results in the formation of Cr carbide during the heat treatment step which Cr carbide may impair the corrosion resistance of the steel. Accordingly, the upper limit of C is set herein as 0.15%.

Cr is a basic alloying element of stainless steels, and at least 10.0% of Cr is required to achieve a satisfactory corrosion resistance. However, since Cr is a ferrite forming element, the presence of an excessive amount of Cr results in the formation of a quantity of δ ferrite, and therefore, in the production of the starting strip, it is difficult to achieve a substantially martensitic phase after annealing and cooling to ambient temperature. Accordingly, the upper limit of Cr is set herein as 17.0%.

Ni is an austenite forming element and serves to effectively stabilize the reversed austenitic phase formed during the heat treatment according to the invention at a temperature within the range from (the As point of the steel+30° C.) to the Af point of the steel. However, if the Ni content is unduly high, in the production of the starting strip, it is difficult to achieve a substantially martensitic phase after annealing and cooling to ambient temperature. Accordingly, the content of Ni is preferably 8.0% or less.

Si acts to broaden the temperature range between the As and Af points. This is advantageous in obtaining a stable duplex structure of austenite and martensite. Si further serves to effectively strengthen the martensitic and reversed austenitic phases formed in the heat treatment according to the invention. However, the production of a steel strip having an unduly high Si content is not easy. Accordingly, the content of Si is preferably 6.0% or less.

Mn is an austenite forming element and serves to effectively stabilize the reversed austenitic phase formed during the heat treatment according to the invention at a temperature within the range from (the As point of the steel+30° C.) to the Af point of the steel. However, if the Mn content is unduly high, there happens such a trouble that Mn fume is formed in the production of such a high Mn steel by melting. Accordingly, the content of Mn is preferably 10.0% or less.

N is an austenite forming element as C is and serves not only to effectively stabilize the reversed austenitic phase formed during the heat treatment according to the invention at a temperature within the range from (the As point of the steel + 30° C.) to the Af point of the steel but also to effectively strengthen the martensitic and reversed austenitic phases. However, the presence of an excessive amount of N results in the formation of blow holes in the production of such a high N steel by melting, and thus does not provide a sound ingot. Accordingly, the content of N is preferably 0.30% or less.

Mo serves not only to enhance the corrosion resistance of the steel but also to effectively strengthen the martensitic and reversed austenitic phases formed in the heat treatment according to the invention. However, since Mo is a ferrite forming element, the presence of an excessive amount of Mo results in the formation of a quantity of δ ferrite, and therefore, in the production of the strip, it is difficult to achieve a substantially martensitic phase after annealing and cooling to ambient temperature. Accordingly, the content of Mo is preferably 4.0% or less.

Cu is an austenite forming element as Ni is and effective in the formation of austenite during the heat treatment according to the invention. However, the presence of an excessive amount of Cu adversely affects the hot workability of the steel. Accordingly, the content of Cu is preferably 4.0% or less.

Co is an austenite forming element as Ni is and effective in the formation of austenite during the heat treatment according to the invention. However, since Co is expensive, the content of Co is preferably 4.0% or less.

Ti, Al, Nb, V and Zr are effective not only in maintaining the stable, fine and uniform duplex structure of martensite and reversed austenite but also in suppressing the formation of Cr carbide to maintain the corrosion resistance. However, since the presence of unduly high amounts of these elements adversely affects the easiness of the production of the steel strip, the amounts of these elements are preferably 1.0% or less in total.

As already discussed, in the process according to the invention, a high strength steel belt having excellent fatigue properties can be produced by reversing a part of martensite to fine austenite to form a fine duplex structure and maintaining the fine duplex structure. Accordingly, it is essential to form a stable fine duplex structure. If the nickel equivalent, $Ni_{eq}$, of the steel is substantially below 8.0, the amount of austenite reversed during the heat treatment at a relatively low temperature within the range of between (the As point + 30° C.) and the Af point is insufficient, and if $Ni_{eq}$ is substantially higher than 17.5, the amount of inverse formed austenite becomes excessively large, and thus, it becomes difficult to realize the desirably stable and fine duplex structure. Accordingly, amounts of alloying elements of the steel are preferably adjusted so that the nickel equivalent, $Ni_{eq}$, of the steel may fall within the range between 8.0 and 17.5.

EXAMPLES

Each steel having a composition indicated in Table 1 was prepared by melting, forged, hot rolled to a thickness of 6 mm, solution treated, pickled, cold rolled, annealed, and finish cold rolled to a thickness of 1 mm. For a purpose of confirming a beneficial effect of shape rectification during the heat treatment according to the invention, cold rolling conditions used were willfully selected so that a cold rolled material having a bad shape might be obtained. Some of the finish cold rolled strips were annealed at a temperature of 1030° C. and pickled. Table 1 indicates the As and Af transformation points of the steels tested as well. These transformation points were determined from inflection points of a temperature-electrical resistance curve obtained on each steel the temperature of which was being raised at a rate of 1° C./min. in an electrical resistance measuring device.

A starting material plate was cut from each strip so prepared, and ends of the plate were welded together by TIG welding to provide an endless belt having a width of 300 mm and a length of 10.5 m. Each belt was heat treated in a heat treatment installation as shown in FIG. 1 under conditions indicated in Table 2. The length of the heat treatment furnace was 1.5 m. The belt was driven at a speed of 1.5 m/min. It took 7 minutes for the belt to make one circular movement during which the material of the belt stayed in the furnace for 1 minute. The heat treatment time A shown in Table 2 is the time of circular movement while heat treatment time B is the sum of the time for which the belt travelled through the heating furnace.

Figure 2:
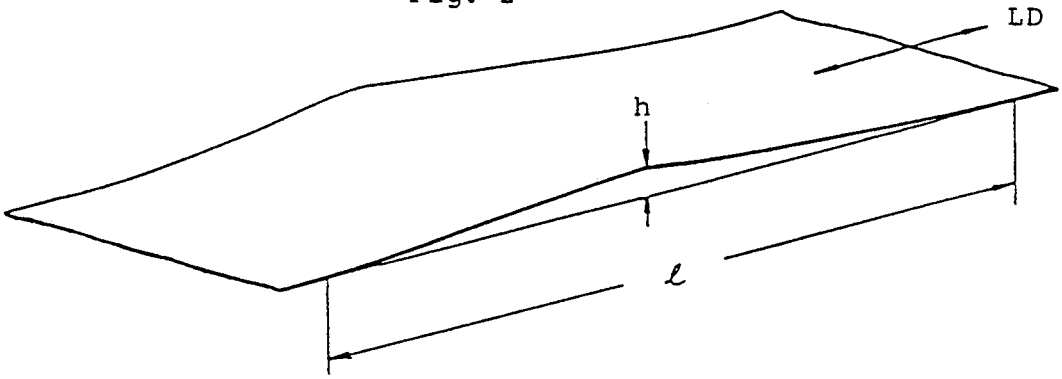
FIG. 2 is a perspective view of a strip for illustrating an LD shape value used herein.
Figure 3:
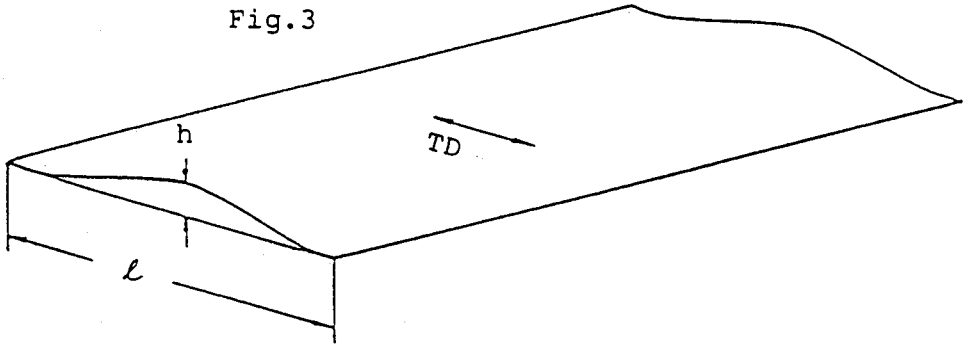
FIG. 3 a perspective view of a strip for illustrating a TD shape value used herein.

After the heat treatment a specimen was taken from the heat treated belt and tested for the proof strength and tensile strength. Furthermore, the shape of the belt was examined before and after the heat treatment. Results are shown in Table 2, wherein the LD shape value is a height of an undulation h (mm) divided by a length 1 (mm) in the rolling direction, as shown in FIG. 2, while the TD shape value is a height of an undulation h (mm) divided by a width l (300 mm) of the belt, as shown in FIG. 3.

From the results shown in Table 2, it is understood that all belts prepared by the process according to the invention have a high strength represented by the proof strength as high as at least 80 kgf/mm² and an excellent shape represented by an LD shape value of not in excess of 2.5/1000 and a TD shape value of not in excess of 1/300. In contrast, belts prepared in control Runs Nos. 2, 6, 9 and 14 outside the scope of the invention are unsuitable as a high strength steel belt because of their bad shape or low strength.

TABLE 1

Chemical Composition and Transformation Points of Steels

| Steel No. | Elements (wt. %) C | Si | Mn | Ni | Cr | N | Others | $Ni_{eq}$ | As (°C.) | Af (°C.) | Metal Structure |
|---|---|---|---|---|---|---|---|---|---|---|---|
| A1 | 0.02 | 0.52 | 0.89 | 4.96 | 14.21 | 0.01 | — | 13.7 | 607 | 771 | Martensite |
| A2 | 0.10 | 0.37 | 0.51 | 1.02 | 12.06 | 0.02 | Mo: 1.02 | 11.1 | 649 | 789 | Martensite |
| A3 | 0.04 | 0.41 | 0.79 | 0.45 | 12.55 | 0.03 | Mo: 0.56 Ti: 0.34 | 8.2 | 618 | 756 | Martensite |
| A4 | 0.01 | 0.33 | 1.53 | 3.11 | 15.55 | 0.02 | Cu: 2.75 Nb: 0.25 | 15.3 | 595 | 755 | Martensite |
| A5 | 0.03 | 0.45 | 5.07 | 2.78 | 14.21 | 0.02 | Co: 2.01 V: 0.31 | 15.5 | 558 | 707 | Martensite |
| A6 | 0.02 | 3.02 | 2.72 | 6.83 | 13.69 | 0.01 | Al: 0.23 B: 0.009 | 17.3 | 582 | 871 | Martensite |
| A7 | 0.02 | 4.08 | 0.22 | 7.19 | 13.33 | 0.02 | Ti: 0.19 REM: 0.010 | 15.3 | 602 | 938 | Martensite |
| A8* | 0.11 | 0.53 | 1.09 | 6.95 | 16.47 | 0.02 | — | 19.1 | 483 | 662 | Austenite |

A8*: Control, austenitic stainless steel

TABLE 2

| | | | Shape Before and After Heat Treatment and Mechanical Properties after Heat Treatment | | | | | | | | | |
|---|---|---|---|---|---|---|---|---|---|---|---|---|
| | | | Cold Rolling | Conditions of Heat Treatment | | | Shape Before Heat Treatment | | Shape After Heat Treatment | | $\sigma$0.2 Proof | Tensile Strength |
| | Run No. | Steel No. | Reduction Rate (%) | Temp. (°C.) | Time A (hr) | Time B (min) | LD h/l (mm) | TD h/l (mm) | LD h/l (mm) | TD h/l (mm) | (kgf/mm$^2$) | (kgf/mm$^2$) |
| Invention | 1 | A1 | 83 | 650 | 10 | 86 | 73/1000 | 31/300 | 1/1000 | 1/300 | 90 | 105 |
| Control | 2 | A1 | 83 | 1030* | 1 | 9 | 73/1000 | 31/300 | 28/1000 | 19/300 | 65 | 105 |
| Invention | 3 | A1 | 63 | 650 | 10 | 86 | 73/1000 | 31/300 | 1/1000 | 1/300 | 88 | 103 |
| Invention | 4 | A1 | 30 | 750 | 1 | 9 | 73/1000 | 31/300 | 2.5/1000 | 0.5/300 | 87 | 105 |
| Invention | 5 | A1 | 0 | 650 | 10 | 86 | 30/1000 | 21/300 | 2.5/1000 | 0.5/300 | 83 | 106 |
| Control | 6 | A1 | 0 | 950* | 5 | 43 | 30/1000 | 21/300 | 25/1000 | 15/300 | 62 | 103 |
| Invention | 7 | A2 | 67 | 680 | 5 | 43 | 83/900 | 39/300 | 2.5/1000 | 1.5/300 | 85 | 103 |
| Invention | 8 | A3 | 67 | 650 | 5 | 43 | 68/1050 | 30/300 | 2/1000 | 1/300 | 92 | 107 |
| Control | 9 | A3 | 67 | 600* | 5 | 43 | 68/1050 | 30/300 | 2.5/1000 | 23/300 | 102 | 108 |
| Invention | 10 | A4 | 67 | 700 | 1 | 9 | 70/1000 | 33/300 | 1/1000 | 1/300 | 95 | 103 |
| Invention | 11 | A5 | 67 | 700 | 1 | 9 | 73/950 | 35/300 | 1/1000 | 1/300 | 91 | 99 |
| Invention | 12 | A6 | 67 | 750 | 1 | 9 | 80/1050 | 31/300 | 0.5/1000 | 0/300 | 101 | 106 |
| Invention | 13 | A7 | 67 | 750 | 1 | 9 | 75/1050 | 29/300 | 0.5/1000 | 0/300 | 107 | 115 |
| Control | 14 | A8* | 25 | 750 | 1 | 9 | 78/1200 | 34/300 | 0.5/1000 | 0/300 | 32 | 70 |

*indicates conditions outside the scope of the invention.
Time A: Time of circular movement of the belt.
Time B: Sum of time for which the belt travelled through the heating furnace.

While the invention has been illustrated by examples wherein the endless belt is caused to repeatedly pass through the heating furnace, it should be appreciated that one pass through the furnace will be sufficient to obtain the similar results, if conditions are appropriately selected. For example, if the speed of the circular movement of the belt is reduced so that the belt may travel through the furnace in heat treatment time B indicated in Table 2, one pass operation is possible.

EFFECT OF THE INVENTION

By the process according to the invention both the properties, flatness and high strength essential in a stainless steel belt, can be concurrently achieved in the step of heat treatment after welding. This means that a steel strip prepared by a process without a step of rolling for shape rectification or a plate cut from such a strip may be used as a starting material for the production of the steel belt, and that steps of flattening by tension before and after the welding step may be eliminated. Accordingly, the invention greatly contributes to saving process steps and enhancing production yields. Furthermore, the production of a wide steel belt including a step of longitudinally welding two or more starting material plates side by side can also be easily carried out by the process according to the invention.

We claim:

1. A process for the production of a high strength steel belt having a duplex structure of austenite and martensite which comprises providing a cold rolled or cold rolled and annealed strip of a martensitic structure from low carbon martensitic stainless steel containing from 10 to 17% by weight of Cr and having a carbon content of not exceeding 0.15% by weight, connecting ends of the strip or ends of a plate cut from said strip to provide an endless belt, causing the endless belt to circularly move between rolls under tension and to repeatedly pass through a heating furnace where the belt is heated to a temperature within a range from (As point of the steel+30° C. ) to Af point of the steel and not higher than 900° C. so that a part of the martensitic phase is changed to a reversed austenitic phase and a desired surface flatness is obtained after cooling, and cooling the heated belt to ambient temperature, wherein the As point of the steel is a temperature of the steel of which temperature is being raised at which the transformation of martensite to austenite begins and the Af point of the steel is a temperature of the steel of which temperature is being raised at which the transformation of martensite to austenite is finished.

2. The process according to claim 1 wherein the endless belt contains up to 20% by volume of a ferritic or austenitic phase before it is caused pass through the heating furnace.

3. The process according to claim 1 wherein the stainless steel contains, in addition to Cr and C, up to 8.0 by weight of Ni, up to 6.0% by weight of Si, up to 10.0% by weight of Mn and up to 0.3% by weight of N.

4. A process for the production of a high strength steel belt having a duplex structure of austenite and martensite which comprises providing a cold rolled or cold rolled and annealed strip of a martensitic structure from low carbon martensitic stainless steel containing from 10 to 17% by weight of Cr and having a carbon content of not exceeding 0.15% by weight, connecting ends of the strip or ends of a plate cut from said strip to provide an endless belt, causing the endless belt to circularly move between rolls under tension and to pass through a heating furnace where the belt is heated to a temperature within a range from (As point of the steel+30° C.) to Af point of the steel and not higher than 900° C. so that a part of the martensitic phase is changed to a reversed austenitic phase and a desired surface flatness is obtained after cooling, and cooling the heated belt to ambient temperature, wherein the As point of the steel is a temperature of the steel of which temperature is being raised at which the transformation of martensite to austenite begins and the Af point of the steel is a temperature of the steel of which temperature is being raised at which the transformation of martensite to austenite is finished.

5. The process according to claim 2 wherein the stainless steel contains, in addition to Cr and C, up to 8.0% by weight of Ni, up to 6.0% by weight of Si, up to 10.0% by weight of Mn and up to 0.3% by weight of N.

* * * * *